US007850745B2

(12) United States Patent
Reaney et al.

(10) Patent No.: US 7,850,745 B2
(45) Date of Patent: Dec. 14, 2010

(54) METHOD FOR CONCENTRATION AND EXTRACTION OF LUBRICITY COMPOUNDS FROM VEGETABLE AND ANIMAL OILS

(75) Inventors: Martin J. Reaney, Saskatoon (CA); Gabriel Piette, Montreal (CA); Philip Barry Hertz, Saskatoon (CA)

(73) Assignee: Her Majesty in Right of Canada as represented by the Minister of Agriculture and Agri-Food Canada, Ottawa, ON (CA)

( * ) Notice: Subject to any disclaimer, the term of this patent is extended or adjusted under 35 U.S.C. 154(b) by 1075 days.

(21) Appl. No.: 11/290,781

(22) Filed: Dec. 1, 2005

(65) Prior Publication Data

US 2007/0124991 A1 Jun. 7, 2007

(51) Int. Cl.
*C10L 1/18* (2006.01)
*C10L 1/19* (2006.01)
*C11B 1/00* (2006.01)

(52) U.S. Cl. ..... 44/389; 44/307; 44/308; 44/388; 554/8; 554/124

(58) Field of Classification Search ..... 554/124, 554/174, 175, 160, 30, 15, 125; 422/188; 44/388, 349, 389, 400, 310, 308, 300, 385, 44/403; 549/413; 426/603, 330.6; 508/186
See application file for complete search history.

(56) References Cited

U.S. PATENT DOCUMENTS

| | | | | |
|---|---|---|---|---|
| 2,098,254 | A | 11/1937 | Mattill | |
| 3,273,981 | A | 9/1966 | Furey | |
| 4,920,691 | A | 5/1990 | Fainman | |
| 5,338,471 | A * | 8/1994 | Lal | 508/186 |
| 5,599,358 | A | 2/1997 | Giavazzi et al. | |
| 5,660,691 | A | 8/1997 | Barnicki | |
| 5,713,965 | A | 2/1998 | Foglia et al. | |
| 5,730,029 | A | 3/1998 | Stoldt et al. | |
| 5,882,364 | A | 3/1999 | Dilworth | |
| 5,917,068 | A | 6/1999 | Barnicki | |
| 6,080,212 | A | 6/2000 | Beimesch et al. | |
| 6,113,971 | A | 9/2000 | Elmaleh | |
| 6,207,209 | B1 | 3/2001 | Jirjis | |
| 6,278,006 | B1 | 8/2001 | Koduli | |
| 6,579,996 | B2 | 6/2003 | Peter | |
| 2001/0042340 | A1* | 11/2001 | Tateno et al. | 44/388 |
| 2001/0044550 | A1* | 11/2001 | Kenneally et al. | 554/125 |
| 2003/0065202 | A1 | 4/2003 | Goto | |
| 2003/0097783 | A1* | 5/2003 | Jordan | 44/307 |
| 2003/0175182 | A1 | 9/2003 | Teall | |
| 2003/0217505 | A1 | 11/2003 | Maubert | |
| 2004/0059142 | A1 | 3/2004 | Bijl | |
| 2004/0102640 | A1 | 5/2004 | Brunner | |
| 2004/0158083 | A1 | 8/2004 | Choo | |
| 2005/0043555 | A1 | 2/2005 | Garro | |

FOREIGN PATENT DOCUMENTS

| | | |
|---|---|---|
| WO | WO 94/17160 | 8/1994 |
| WO | 2005/051294 | 6/2005 |

OTHER PUBLICATIONS

Alsberg et al. "The Fats and Oils", Jun. 2, 2002; HTTP:// journeytoforever.org/biofuel library/fatsoils/fatsoils3a.html.*
Final Office Action for U.S. Appl. No. 11/600,747 dated Jun. 1, 2009.
Non-Final Office Action for U.S. Appl. No. 11/600,747, dated Dec. 1, 2008.
"Fats and Fatty Oils", Thomas, A. ; Ullman's Encyclopedia of Industrial, Chemistry; Jun. 15, 2000.
EP 06817666, Supplementary European Search Report.
Purification of Tocopherols and Phytosterols by a Two-Step in situ Enzymatic Reaction; Author: Watanabe et al.; Journal of the American Oil Chemists' Society, Springer, vol. 81, No. 4, Apr. 1, 2004, pp. 339-345.
CIPO withdrawn Examiner's Report dated Mar. 12, 2010 for co-pending Canadian Patent Application No. 2,631,134, 6 pages.
CIPO courtesy letter dated Mar. 24, 2010 cancelling report sent in error on Mar. 12, 2010 for co-pending Canadian Patent Application No. 2,631,134, 1 page.
CIPO Examiner's Report dated Apr. 8, 2010 for co-pending Canadian Application No. 2,631,134, 7 pages.

* cited by examiner

*Primary Examiner*—Ellen M McAvoy
*Assistant Examiner*—Chantel Graham

(57) ABSTRACT

Methods for recovery of concentrates of lubricating compounds from vegetable and animal oils, fats and greases that allow separation of triglycerides, from components with higher lubricity or enrichment protocols that increase the concentration of high lubricity compounds in the triglyceride. The triglycerides are transesterified with a lower alcohol to produce alkyl esters. Following the conversion process the esters are separated from high molecular weight high lubricity compounds by distillation. The esters have some lubricity and may be sold as pollution reducing fuel components. The high boiling point compounds that are the residues of distillation, however, can contribute significant lubricity and may be used widely in lubricant applications or added to petroleum fuels to decrease friction.

10 Claims, No Drawings

METHOD FOR CONCENTRATION AND EXTRACTION OF LUBRICITY COMPOUNDS FROM VEGETABLE AND ANIMAL OILS

FIELD OF INVENTION

The present invention relates to methods for producing a high lubricity fraction from vegetable oils and animal fats, oils and greases. The novel methods either separate lower lubricity components of the fat, oil, or grease from higher lubricity fractions or enrich the concentration of high lubricity components or combines extraction and enrichment. In a preferred embodiment the lower lubricity components are made volatile by chemical reactions that split the triglyceride component of fat, oil, or grease. These reactions may produce industrially useful products such as fatty acid methyl esters, fatty acids or fatty amides of the original fat, oil, or grease which may be separated from the higher lubricity components by distillation. The lower lubricity components from fat splitting have inherent value that is not diminished by the separation of the high lubricity fraction. In fact, the low lubricity fraction may have increased value as a result of the separation. The high lubricity fraction is a collection of higher molecular weight substances present in the fat, oil or grease or a modified component thereof. In another preferred embodiment the high lubricity component of the fat, oil or grease is separated from the triglyceride by absorption onto a solid phase medium. Depending on the nature of the solid phase extraction medium either the lower lubricity components or the higher lubricity components are preferentially bound to the solid phase extraction medium. The concentrate is then recovered from the solid phase by extraction or from the liquid phase by evaporation. In a further preferred embodiment the separation of higher lubricity and lower lubricity components is achieved by crystallisation from a solvent.

Extraction procedures may also be manipulated to improve the content of compounds that impart lubricity to the fat, oil or grease. In a preferred embodiment canola seed is mechanically pressed to remove oil that has lower levels of the desired high lubricity compounds. Mechanical extraction of the seed is followed by solvent extraction that produces oil with surprising level of lubricity. The lubricity is imparted through the high ratio of lubricity enhancing products to triglyceride extracted with the oil.

BACKGROUND OF THE INVENTION

Since 1993, environmental legislation in the U.S. has required that the sulfur content of diesel fuel be less than 0.05%. The reduction in the sulfur content of diesel fuel has resulted in lubricity problems. It has become generally accepted that the reduction in sulfur is also accompanied by a reduction in polar oxygenated compounds and polycyclic aromatics including nitrogen-containing compounds responsible for the reduced boundary lubricating ability of severely refined (low sulfur) fuels. While low sulfur content is not in itself a lubricity problem, it has become the measure of the degree of refinement of the fuel and thus reflects the level of the removal of polar oxygenated compounds and polycyclic aromatics including nitrogen-containing compounds.

Low sulfur diesel fuels have been found to increase the sliding adhesive wear and fretting wear of pump components such as rollers, cam plate, coupling, lever joints and shaft drive journal bearings.

Concern for the environment has resulted in moves to significantly reduce the noxious components in emissions when fuel oils are burnt, particularly in engines such as diesel engines. Attempts are being made, for example, to minimize sulfur dioxide emissions by minimizing the sulfur content of fuel oils. Although typical diesel fuel oils have in the past contained 1% by weight or more of sulfur (expressed as elemental sulfur) it is now considered desirable to reduce the level, preferably to 0.05% by weight and, advantageously, to less than 0.01% by weight, particularly less than 0.001% by weight.

Additional refining of fuel oils, necessary to achieve these low sulfur levels, often results in a reduction in the levels of polar components. In addition, refinery processes can reduce the level of polynuclear aromatic compounds present in such fuel oils.

Reducing the level of one or more of the sulfur, polynuclear aromatic or polar components of diesel fuel oil can reduce the ability of the oil to lubricate the injection system of the engine. As a result of poor fuel lubrication properties the fuel injection pump of the engine may fail relatively early in the life of an engine. Failure may occur in fuel injection systems such as high-pressure rotary distributors, in-line pumps and injectors. The problem of poor lubricity in diesel fuel oils is likely to be exacerbated by future engine developments, aimed at further reducing emissions, which will result in engines having more exacting lubricity requirements than present engines. For example, the advent of high-pressure unit injectors increases the fuel oil lubricity requirement.

Similarly, poor lubricity can lead to wear problems in other mechanical devices dependent for lubrication on the natural lubricity of fuel oil.

Lubricity additives for fuel oils have been described in the art. WO 94/17160 describes an additive, which comprises an ester of a carboxylic acid and an alcohol, wherein the acid has from 2 to 50 carbon atoms and the alcohol has one or more carbon atoms. Glycerol monooleate is an example. Although general mixtures were contemplated, no specific mixtures of esters were disclosed.

U.S. Pat. No. 3,273,981 discloses a lubricity additive being a mixture of A+B wherein A is a polybasic acid, or a polybasic acid ester made by reacting the acid with $C_1$-$C_5$ monohydric alcohols; while B is a partial ester of a polyhydric alcohol and a fatty acid, for example glyceryl monooleate, sorbitan monooleate or pentaerythitol monooleate. The mixture finds application in jet fuels.

U.S. Pat. No. 6,080,212 teaches of the use of two esters with different viscosity in diesel fuel to reduce smoke emissions and increase fuel lubricity. In one preferred embodiment of that invention methyl octadecenoate, a major component of biodiesel, was included in the formula. Similarly, U.S. Pat. No. 5,882,364 also describes a fuel composition comprising middle distillate fuel oil and two additional lubricating components. Those components being (a) an ester of an unsaturated monocarboxylic acid and a polyhydric alcohol and (b) an ester of a polyunsaturated monocarboxylic acid and a polyhydric alcohol having at least three hydroxy groups.

The approach of using a two component lubricity additive was pioneered in U.S. Pat. No. 4,920,691. The inventors describe an additive and a liquid hydrocarbon fuel composition consisting essentially of a fuel and a mixture of two straight chain carboxylic acid esters, one having a low molecular weight and the other having a higher molecular weight.

In U.S. Pat. No. 5,713,965 the synthesis of alkyl esters from animal fats, vegetable oils, rendered fats and restaurant grease is described. The resultant alkyl esters are reported to be useful as additives to automotive fuels and lubricants.

Alkyl esters of fatty acids derived from vegetable oleaginous seeds were recommended at rates between 100 to 10,000 ppm to enhance the lubricity of motor fuels in U.S. Pat. No. 5,599,358. Similarly a fuel composition was disclosed in U.S. Pat. No. 5,730,029 comprising low sulfur diesel fuel and esters from the transesterification of at least one animal fat or vegetable oil triglyceride.

SUMMARY OF THE INVENTION

It is known by those skilled in the art that fuel additives that enhance lubricity may be produced that contain lower alkyl esters of fats, oils and greases yet surprisingly it is revealed, in the present invention, that these mixtures contain ingredients with substantially higher lubricity. Furthermore methods are disclosed to efficiently recover these high lubricity components. In preferred methods the triglyceride components of the fat, grease or oil are converted to lower molecular weight compounds such as fatty acids, fatty amides or fatty acid alkyl esters. In forming the lower molecular weight compound it becomes possible to readily separate the bulk material from the high lubricity components by distillation. In a preferred embodiment the fat, oil or grease is transesterified to produce a lower alkyl ester using methods known to those skilled in the art. The ester is then distilled and recovered for other purposes and the column bottoms of distillation are recovered and refined to remove free acids formed in distillation. The refined column bottoms recovered from the distillation have substantial efficacy as lubricity additives. In another preferred embodiment the fat, oil or grease is converted to fatty acids. The fatty acids are then distilled and recovered for other purposes and the column bottoms of distillation are recovered and refined to remove residual free acids formed in distillation. The refined column bottoms also have substantial efficacy as lubricity additives. The lubricity concentrate comprises a complex mixture of phospholipid, sterol, tocopherol, quinone, polyisoprene and polyisoprenol and other lipid soluble components. In a preferred embodiment of the present invention where the concentrate is an enriched concentrate of lipid substances with molecular weights greater than 400.

While the present invention may be accomplished through fat splitting or other chemical modification followed by crystallisation or distillation as preferred methods of concentrating the lubricity fraction, other methods of concentrating specific classes of oil soluble compounds from triglyceride are also acceptable. For example, those skilled in the art will recognise that it is possible to recover enriched fractions from fats, oils and greases by solid phase extraction and chromatographic methods. Solid phase extraction may be combined with chemical modification steps or the chemical modification may be forgone in the process of preparing the high lubricity concentrates.

Furthermore we have made the surprising discovery that the method of processing the oil may also act to concentrate the oil soluble components that impart lubricity. Processing conditions may be modified to enhance the extraction of high lubricity minor components of oilseed and animal fat. The present invention includes pre-extraction treatments that enhance either or both the concentration of high lubricity components in oils.

In a preferred embodiment of the present invention the concentrate is enriched in dolichol, other polyisoprenois and their derivatives.

DETAILED DESCRIPTION OF THE INVENTION

Vegetable oils, such as tall, soybean, canola, palm, sunflower, rapeseed, flaxseed, corn or coconut, are a complex mixture of molecular components of which triglycerides are usually the most abundant component. Similarly, animal fats and greases, such as those derived from swine, poultry and beef, are predominantly triglyceride in composition. Triglycerides are triesters of glycerol and carboxylic acids that have great industrial importance. In industry triglycerides are reacted with water to form fatty acids, hydrogen to form fatty alcohols, amines to form fatty amides and alcohols to form alkyl esters. Triglycerides have relatively high molecular weights, usually greater than 800 amu and thus are difficult to distill. However, fatty acids, fatty amides, fatty alcohols and fatty alkyl esters of lower alcohols have lower molecular weights and are readily distilled under vacuum. The residue left after vacuum distillation is a concentrate of substances with molecular weights above those of the fatty acid, amide, alcohol or ester.

Lubricity Measurements:

Laboratory Method:

Lubricity is measured using a Munson Roller On Cylinder Lubricity Evaluator (M-ROCLE; Munson, J. W., Hertz, P. B., Dalai, A. K. and Reaney, M. J. T. Lubricity survey of low-level biodiesel fuel additives using the "Munson ROCLE" bench test, SAE paper 1999-01-3590). The M-ROCLE test apparatus conditions are given in Table1. During the test, the reaction torque was proportional to the friction force produced by the rubbing surfaces and was recorded by a computer data acquisition system. The recorded reaction torque was used to calculate the coefficient of friction with the test fuel. The image of each wear scar produced on the test roller was captured by a video camera mounted on a microscope and was transferred to image processing software, from which the wear scar area was measured. After determining the unlubricated Hertzian contact stress, a dimensionless lubricity number (LN), indicating the lubricating property of the test fuel, was determined using the following equation:

$$LN=S_{ss}/s_H m_{ss};\ s_{ss}=P/A$$

Where:

$s_{ss}$=steady state ROCLE contact stress (mPa);

$s_H$=Hertzian theoretical elastic contact stress (mPa);

Kerosene Reference Fuel was Escort Brand 1-K Triple Filtered, Low Sulfur, Canadian Tire Stock No. 76-2141-2, Lot 135, BO2943. Each fuel ester sample was lubricity tested six times on the machine followed by a calibration of the reaction torque.

TABLE 1

M-ROCLE TEST CONDITIONS

| | |
|---|---|
| Fuel temperature, ° C. | 25 ± 1.5 |
| Fuel capacity, mL | 63 |
| Ambient temperature, ° C. | 24 ± 1.0 |
| Ambient humidity, % | 35-45 |
| Applied load, N | 24.6 |
| Load application velocity, mm/s | 0.25 |
| Test duration, min | 3 |
| Race rotational velocity, rpm | 600 |
| Race Surface velocity, m/s | 1.10 |
| Test specimens | |
| Falex test cylinder, F-S25 test rings, SAE 4620 steel | |
| Outer diameter, mm | 35.0 |
| Width, mm | 8.5 |

TABLE 1-continued

| M-ROCLE TEST CONDITIONS | |
|---|---|
| Falex tapered test rollers, F-15500, SAE 4719 steel | |
| Outer diameter, mm | 10.18, 10.74 |
| Width, mm | 14.80 |

Field Test Method:

Motor oil analysis was utilized to infer engine wear. This involved high-resolution Inductively Coupled Plasma (ICP) Spectrometry analysis of the used oil wear particles and oil additive elements. Ferrography, and magnetic particle analysis was determined for larger (>5 μm) wear particles. Physical and chemical analyses of oil viscosity, acid neutralizing-ability (Total Base Number (TBN) and Total Acid Number (TAN)), and any dilution by fuel, water, or glycol was also monitored. An independent laboratory, Fluid Life Corporation in Edmonton Alberta, conducted these analytical tests.

All motor oil analysis data was adjusted to calculate true wear rates considering oil volumes present in the crankcase, oil consumed, sample volumes, and oil additions. All wear metals were monitored, with engine wear iron examined most critically. As well, by sectioning the filters after each oil change, filter wear and contaminant particles were microscopically and spectrographically compared. Field test logs indicating daily ambient minimum and maximum temperatures, numbers of cold and hot starts, ratios of city to highway driving, and liters of fuel consumed were tabulated. Consistent driving styles were enforced. Fuel economy and any operational difficulties were noted throughout the test program. Esso brand regular unleaded gasoline and Pennzoil Multigrade SJ motor oils were used throughout the study. The canola additives were prepared or obtained as described in specific examples.

Calculation of True Wear Rate

Consider for example, a vehicle engine that operates "normally" or "ideally", generating and depositing in the crankcase oil a constant 10 parts per million (10 ppm) of iron (Fe) in every 1,000 km of operation. Its "true wear rate" would be calculated by dividing the particle count by the distance traveled, yielding 10 ppm/1,000 km. Here, round numbers have been used to assist the reader in understanding the procedure. If the vehicle were operated for 10,000 km under uniform conditions the wear iron level would rise 10 fold to 100 ppm Fe. This rise in ppm could start from zero ppm for an initially "flushed clean" engine, or more often from some initial "reference" level, taken shortly after an oil change. A typical oil and filter change typically leaves 10% to 15% of the used oil behind, so referencing is an important initial first step in a comparative engine wear analysis.

If the crankcase capacity of the example engine is 10L, the amount of elemental iron deposited in the oil after 10,000 km can be calculated as follows:

The 100 ppm Fe is present in the 10L crankcase volume.

Therefore the iron wear volume is obtained by multiplying the iron concentration by the oil volume:

$$100 \text{ parts Fe}(10^{-6})\times 10\text{L}=1{,}000\ \mu\text{L Fe}.$$

This 1,000 μL Fe is the engine wear volume under ideal 10,000 km conditions.

If the engine oil was referenced at, say 70 km, and found to contain 10 ppm Fe, this would cause the final test reading after the 10,000 km to be 10 ppm higher:

$$100 \text{ ppm}+10 \text{ ppm}=110 \text{ ppm}.$$

So to correct for initial residual iron one must subtract the reference ppm from the final test ppm, to obtain the "net" wear iron, which in this case is still:

$$110 \text{ ppm}-10 \text{ ppm}=100 \text{ ppm}.$$

Oil sampling itself requires a small amount of oil (~200 mL) to be withdrawn from the crankcase each time the wear metals are monitored.

Assume 5 oil samples of 0.2L=1.0L of oil was removed during the 10,000 km run.

The average net ppm Fe concentrations in these 5 samples would be close to the average net crankcase concentration of 50 ppm, which started at 0 ppm and ended at 100 ppm.

This oil sampling has caused two things to happen:

(a) There is now 1.0L less oil in the 10.0L crankcase due to the sampling, i.e. 9.0L.

(b) 1.0L of oil containing, on net average, ~50 ppm Fe has been removed.

The indicated final net test value would no longer equal 100 ppm Fe but can be calculated by doing a wear iron balance on the removal of iron activity as follows:

$$(100 \text{ ppm}\times 10\text{L})-(50 \text{ ppm}\times 1\text{L})=\text{Test Fe ppm}\times 9\text{L},$$

Solving for the Test Iron level in ppm, we obtain:

$$\text{Test ppm}=(1000\ \mu\text{L Fe}-50\ \mu\text{L Fe})/9\text{L},$$

$$\text{Test ppm}=950\ \mu\text{L}/9\text{L}=105.5 \text{ ppm Fe}.$$

Due to sampling the "wear rate" based on the final test value of 105.5 ppm Fe, instead of the true net previous 100.0 ppm value, would be calculated in error as too high at:

$$105.5 \text{ ppm Fe}/10{,}000 \text{ km, or, } 10.55 \text{ ppm Fe}/1000 \text{ km}.$$

To compensate for sampling, "adding back" the oil sample volumes with new oil, each time a sample was taken, could be tried. New oil may contain small levels of wear metals (0.0-2.0 ppm Fe) and high levels of additive metals (800-1200 ppm Zn).

Focusing, for now, on the iron, we can do another iron balance taking into account the 1.0L sampling volumes and the 1.0L add-back volumes (at 1 ppm Fe for new oil) as follows, starting with the previous true wear iron level:

$$(100 \text{ ppm}\times 10\text{L})-(50 \text{ ppm}\times 1\text{L})+(1 \text{ ppm}\times 1\text{L})=\text{Test ppm}\times 10\text{L} \quad \text{(Eq. 1)}$$

$$\text{Test ppm}=(1000\ \mu\text{L Fe}-50\ \mu\text{L Fe}+1\ \mu\text{L})/10\text{L}$$

$$\text{Test ppm}=951/10=95.1 \text{ ppm Fe}$$

After taking samples, and adding oil back, the indicated wear rate result based on the final sample is now too low, at 95.1 ppm Fe/10,000 km or 9.51 ppm Fe/1000 km.

If an engine "uses" oil, this volume will be similar to us taking out oil samples. If the oil is "topped-up" to the full mark, this is like adding back new oil after sampling. If the crankcase ends up below or above "full", this can also be taken into account with reference to the previous two examples.

It is desired to calculate the "true ppm" based on a "test ppm" wear indication. In more general terms the previous iron balance ( Eq. 1) can be rewritten as follows:

(True ppm×Start L)−(True ppm×Used L/2)+(New ppm×Add L)=Test ppm×Test L $$\text{True ppm} = \frac{(\text{Test ppm} \times \text{Test } L) + (\text{True ppm} \times \text{Used } L/2) - (\text{New ppm} \times \text{Add } L)}{\text{Start } L} \quad \text{(Eq. 2)}$$

For True ppm, we can approximate the True ppm in the second term of (Eq. 2) equal the Test ppm, to get (Eq. 3):

$$\text{True ppm} = \frac{(\text{Test ppm} \times \text{Test } L) + (\text{Test ppm} \times \text{Used } L/2) - (\text{New ppm} \times \text{Add } L)}{\text{Start } L} \quad \text{(Eq. 3)}$$

Using the Test 95.1 ppm value from the example above, and substituting into (Eq. 3), yields a reasonably good True Fe value, close to the known 100.0 ppm, as:

$$\text{True ppm} = \frac{(95.1\ \text{ppm} \times 10\ \text{L}) + (95.1\ \text{ppm} \times 1\ \text{L}/2) - (1\ \text{ppm} \times 1\ \text{L})}{10\ \text{L}} = 99.75\ \text{ppm Fe}$$

If a higher accuracy is required this 99.75 ppm value can be substituted for the Test ppm yielding:

$$\text{True ppm} = \frac{(95.1\ \text{ppm} \times 10\ \text{L}) + (99.75\ \text{ppm} \times 1\ \text{L}/2) - (1\ \text{ppm} \times 1\ \text{L})}{10\ \text{L}} = 99.99\ \text{ppm Fe}$$

Therefore the following, repeated, Equation 3 can be used to calculate "True Wear" or "Normalize" indicated lubricant test results based on oil volumes used or sampled, crankcase capacity, new oil added, or any combination of the above:

$$\text{True ppm} = \frac{(\text{Test ppm} \times \text{Test } L) + (\text{Test ppm} \times \text{Used } L/2) - (\text{New ppm} \times \text{Add } L)}{\text{Start } L} \quad \text{(Eq. 3)}$$

EXAMPLES

Example 1

Two Stage Transesterification of Canola Oil with Methanol and Potassium Hydroxide Methyl esters of canola oil, also known to those skilled in the art as low erucic acid rapeseed oil, were prepared using a two-stage base catalysed transesterification. The two-stage reaction was required to remove glyceride from the final product. Prior to the reaction the catalyst was prepared by dissolving potassium hydroxide (10 g) in methanol (100 g). The catalyst solution was divided into two 55 g fractions and one fraction was added to 500 g of canola oil (purchased from a local grocery store) in a 1L beaker. The oil, catalyst and methanol were covered and stirred vigorously for 1 hour on a stirring hot plate by the addition of a teflon stirring bar. After stirring, the contents of the beaker were allowed to settle for 2 hours. At this time a cloudy upper layer and a viscous lower layer had separated. The layers were separated using a seperatory funnel and the upper layer was mixed with the remaining potassium hydroxide in methanol solution. This second mixture was stirred vigorously in a covered beaker for 1 hour and allowed to settle overnight. The mixture settled to form two layers. The upper layer was collected using a seperatory funnel and used for further refining steps.

Example 2

Two Stage Transesterification of Tallow with Methanol and Potassium Hydroxide Tallow was collected from a renderer. Five hundred grams of tallow were heated to 40° C. prior to esterification to liquify the solid mass. Thereafter, all processes and conditions were identical to those described in example 1.

Example 3

Refining and Distillation of Canola Oil Methyl Ester

Canola methyl ester prepared in example 1 was refined to remove methanol, glycerol, soaps and other compounds that might interfere with distillation. Methanol was removed under vacuum (28.5") by a rotary vacuum evaporator equipped with a condenser. The methyl esters were maintained at 50° C. for 30 minutes to thoroughly remove alcohol. After evaporation the esters were treated with silica (0.25% w/w Trisyl 600; W. R. Grace Co.) and stirred at room temperature for 1 hour. After silica treatment methyl esters were filtered over a bed of Celite to remove both silica and other materials.

After refining the methyl esters, fractional high vacuum distillation was performed using a simple distillation apparatus. A vacuum of less than 1 mm was maintained throughout the procedure. During fractionation temperatures at the top of the column, before the condenser, were between 120° C. and 140° C. The distillation apparatus included a liquid nitrogen cooled vapour trap, which allowed the attainment of high vacuum conditions. Approximately 500 mL of distillate (about half the sample) was obtained and then the heating mantle was removed while maintaining the apparatus under vacuum. Vacuum was then broken and fractions of both distillate and bottoms were obtained for further studies. Distillation was then resumed until a further 200 mL of distillate were obtained (about half the sample). The apparatus was again chilled, vacuum was broken and samples of 100 mL of both bottoms and distillate were recovered. All samples of bottoms and distillate were analysed to determine the content of soaps and free fatty acids using AOCS methods Cc 17-95 and Ca 5a-40 respectively.

Some samples of column bottoms were noted to have elevated levels of free fatty acids. These samples were treated by briefly contacting with a mixture of 1 molar potassium hydroxide dissolved in glycerol to convert the fatty acids to soaps. The glycerol phase was easily separated from the oil phase by decanting. Following alkaline glycerol treatment silica (0.25% w/w Trisyl 600) and was added to the oil phase and the phase was filtered over a bed of celite.

Example 4

Refining and Distillation of Tallow Methyl Ester

Tallow esters were refined and distilled as described for rapeseed esters in Example 3.

Example 5

Lubricity Testing of Methyl Canola and Tallow Esters

Lubricity was measured using a Munson Roller On Cylinder Lubricity Evaluator (M-ROCLE; Munson, J. W., Hertz, P. B., Dalai, A. K. and Reaney, M. J. T. Lubricity survey of low-level biodiesel fuel additives using the "Munson ROCLE" bench test, SAE paper 1999-01-3590). The M-ROCLE test apparatus conditions are given in Table1. M-ROCLE operation and equations used to describe lubricity number are described above. Table 2 describes the samples subjected to analysis.

Lubricity testing was performed on the first distillate and column bottoms, which constituted about a four-fold concentrate of high boiling substances. A total of 6 replications were performed to allow for statistical analysis. All tests were performed on a 1% solution of concentrate or distillate in kerosene. Table 3 contains the results of analyses.

In testing it was found that kerosene produced the lowest lubricity number and that all treatments increased lubricity number with respect to controls. Among the treated samples the concentrates consistently demonstrated the highest lubricity numbers. The lubricity numbers for concentrates of canola and the two tallow samples were not significantly different from each other and in all cases the concentrates had greater lubricity than the distillates. The lubricity numbers noted for the distillates were lower than the concentrates, though higher than controls, indicating that only half of the improvement in lubricity number was contributed by the distilled methyl ester. In the two tallow samples it was found that prior to distillation the lubricity number was similar to the lubricity number for the concentrate.

Uniformly it was found that all treatments also decreased wear scar area. Surprisingly it was found that although distilled methyl esters significantly decreased wear scar area concentrates produced the lowest wear scar areas. For example, canola methyl ester (sample number 1) produced a wear scar area of 0.2907 $mm^2$ while the distillate and concentrate of this sample produced wear scars of 0.2783 $mm^2$ and 0.2557 $mm^2$ respectively (Table 3).

It was discovered that the treatments had little impact on the coefficient of friction in the current test.

TABLE 2

Description of refining and distillation conditions used to prepare lubricity enhanced concentrates
All additive samples were Trisyl treated and Celite Filtered Methyl Esters

| Bottle Sample # | Base Material for Methyl Ester | Fatty Acid % | Bottle Wt. gr. |
|---|---|---|---|
| #1 | Canola Oil | 0.04% | 104 |
| #2 | Canola Oil | 0.07% | 105 |
| #3 | Distillate Canola Oil | 0.07% | 84 |
| #4 | Concentrate Tallow 1 | 0.07% | 93 |
| #5 | Tallow 1 | 0.07% | 96 |
| #6 | Distillate Tallow 1 | 0.10% | 90 |
| #7 | Concentrate Tallow 2 | 0.03% | 88 |
| #8 | Tallow 2 | 0.06% | 84 |
| #9 | Distillate Tallow 2 Concentrate | 0.07% | 98 |

TABLE 3

| Sample number* | Lubricity Number (n = 6) | Standard Deviation | Wear Scar Area (mm^2) (n = 6) | Standard Deviation [mm^2] | Coefficient of Friction (n = 6) | Standard Deviation |
|---|---|---|---|---|---|---|
| Kerosene | 0.7547 | 0.0778 | 0.3195 | 0.0238 | 0.1142 | 0.0050 |
| #1 | 0.8620 | 0.0579 | 0.2907 | 0.0029 | 0.1210 | 0.0034 |
| #2 | 0.8341 | 0.0484 | 0.2783 | 0.0183 | 0.1095 | 0.0017 |
| #3 | 0.9464 | 0.0706 | 0.2557 | 0.0121 | 0.1180 | 0.0022 |
| #4 | 0.9561 | 0.0552 | 0.2410 | 0.0222 | 0.1136 | 0.0022 |
| #5 | 0.8373 | 0.0352 | 0.2763 | 0.0120 | 0.1189 | 0.0020 |
| #6 | 0.9625 | 0.0456 | 0.2446 | 0.0102 | 0.1183 | 0.0019 |
| #7 | 0.9348 | 0.0438 | 0.2623 | 0.0113 | 0.1163 | 0.0023 |
| #8 | 0.8513 | 0.0492 | 0.2723 | 0.0092 | 0.1116 | 0.0013 |
| #9 | 0.9555 | 0.0712 | 0.2547 | 0.0162 | 0.1182 | 0.0009 |

*number corresponds to sample number in table 2

Example 6

Impact of oil extraction and refining procedures on the lubricity of canola oil Approximately twenty kg (20.8) of canola seed was crushed in a Komet expeller press through a 6 mm die face producing 7.9 kg of oil with fines and 12.8 kg of meal. The oil was clarified by passing over glass wool followed by centrifugation at 2000×g for 15 min in a swing out rotor. The mass of the clarified oil was 7.2 kg. This oil was identified as pressed and unrefined or P-0. The meal arising from pressing was extracted with hexane in 1.4 kg batches in a soxhlet extractor. The hexane was collected and evaporated in a rotary evaporator producing 1.5 kg of solvent extracted oil. This oil is identified as solvent extracted and unrefined or S-0. The combined oil yield from the two processes was 42% of the original seed mass. The two samples of oil were used for further processing and analysis. Blending the crushed and solvent extracted oils at a ratio of 5:1 produced the third sample. This oil is identified as pressed, solvent extracted and unrefined or PS-0.

All oil samples were analyzed to determine the level of sterols (NMR), free fatty acids (AOCS Ca 5a-40), minerals (ICP) and lubricity (Munson ROCLE).

Oils (P-0, S-0 and PS-0) were degummed by adding 0.2% by weight of fifty percent citric acid to the oil while heating to 40-45° C. for 30 minutes with agitation. After reaction with the acid an additional of 2% of water (w/w) was added. The water treated oils were then heated to 60-70° C. for a further 20 minutes then centrifuged (2,000×g for 15 minutes). The upper layer of clear oil was recovered and analyzed to determine FFA, minerals and lubricity. Degumming produced three oil products: pressed degummed oil, P-1; solvent extracted degummed oil, S-1; and pressed and solvent extracted degummed oil PS-1

Approximately 300 g of each oil (P-1, S-1 and PS-1) was neutralized or alkali refined, for further analyses and processing. Alkali refining was achieved by adding a solution of 10% (w/w) sodium hydroxide to the degummed oil. The free fatty acid level was used to determine the stoichiometric amount of sodium hydroxide solution required for neutralization with a small excess. Neutralization was accomplished at 60-70° C. with a reaction time of 5 minutes with agitation. After neutralization the oil and soap water solution were separated by centrifugation (2,000×g for 15 minutes). The oil had a cloudy appearance. Evaporation of the cloudy oil produced clear oil that was analyzed for FFA, minerals and lubricity. Neutralization produced three oil products: Pressed neutralized oil, P-2; solvent extracted neutralized oil, S-2; and pressed and solvent extracted neutralized oil PS-2.

The alkali refined, neutralized oils (P-2, S-2 and PS-2) were bleached by the addition of 1% (w/w) bleaching clay to oil that had been preheated to 110° C. under vacuum. The oil was agitated in the presence of the bleaching clay for 30 min after which the temperature was allowed to fall to 60° C. prior to release of the vacuum. The oil and clay were then filtered through a bed of celite and Whatman No. 1 filter paper in a Buchner funnel. The filtered oil was analyzed to determine FFA, minerals and lubricity. Bleaching produced three oil products: Pressed bleached oil, P-3; solvent extracted bleached oil, S-3; and pressed and solvent extracted bleached oil PS-3.

In the final stage of processing the oils (P-3, S-3 and PS-3) were deodorized by passage through a 2.0 inch diameter Pope wiped film still. The still was adjusted to deliver oil at 2 mL/min, evaporation temperature was 170° C. and vacuum was $10^{-2}$ mbar. Deodorizing produced three oil products: Pressed deodorized oil, P-4; solvent extracted deodorized oil, S-3; and pressed and solvent extracted deodorized oil PS-3.

Sterol is observed as a peak at 0.66 ppm in the proton NMR spectrum. The peak is small but may be quantified with a sufficiently powerful spectrometer. The level of sterol in the solvent extracted portion of the oil is approximately the level found in the pressed oil (Table 4). With the exception of deodorizing treatments none of the refining steps affected the measured level of sterol.

Nine different mineral elements are observed in the ICP data including silicon, sodium, potassium, iron, boron, phosphorous, zinc, calcium, and magnesium. The amounts of most minerals are higher in solvent extracted oils than the pressed oil. Refining tends to remove minerals but its effect is different among the three samples. Degumming reduced the phosphorous content of pressed oil from 8 to 4 ppm (P-0 vs P-1) and from 168 to 57 ppm in the mixed oil (PS-0 vs. PS-1) but had no effect on the level of phosphorous (1030 ppm) in the solvent extracted oil (S-0 vs. S-1). Upon completion of all refining steps the pressed oil was virtually devoid of all mineral contamination showing only traces of tin (1 ppm, probably spurious) and silicon (7 ppm). Refining similarly improved the quality of the mixed oil (PS-4) where only traces of silicon, phosphorous, calcium and magnesium (3,2,2 and 2 ppm respectively) were observed. Full refining was not useful in removing materials from the solvent extracted oil where silicon, sodium, phosphorous, calcium and magnesium were observed at appreciable levels (10, 41, 197, 225 and 69 ppm respectively). Trace levels of potassium and lead were reported but the latter measurement was likely spurious instrument noise.

The effect of the three oils at all stages of refining on kerosene lubricity was evaluated by preparing a 1% (w/w) solution in kerosene and testing in a Munson Roller On Cylinder Lubricity Evaluator to determine the coefficient of friction and wear scar area. Lubricity number (LN) was calculated from the two numbers. Wear scar area was greatly reduced by all treatments. Several differences were observed among treatments but generally the size of differences among treatments was much smaller than the difference between untreated kerosene and the individual treatments. Wear scar area was for all three unrefined oils from all treatments. Degumming resulted in oils that produced a larger wear scar. Other refining treatments did not affect wear scar significantly.

All treatments lowered the coefficient of friction but substantial differences among treatments were observed. Alkali refined oils that had a greater coefficient of friction in all cases while bleaching reduced friction coefficients only for solvent extracted oil (S and PS, Table 4). Deodorizing also increased the coefficient of friction for the two solvent extracted oils. On average the coefficient of friction was lowest in oils containing the solvent extracted components.

Lubricity number reflects the effect of the oil on both wear scar and coefficient of friction. All oils regardless of the treatment increase the lubricity number. The solvent extracted oil provided the greatest increase in lubricity number over the blended and pressed oil types. Refining does not appear to affect the LN of pressed oil while it does result in interesting changes in the LN of the solvent extracted fractions. In the solvent extracted oils it is seen that degumming the oil lowers LN. Alkali refining has little additional affect on LN but bleaching appears to restore the LN though not to the levels observed in unrefined oil. Deodorizing lowers LN in the solvent extracted and the blend oils.

TABLE 4

Effect of oil refining on select metal component concentrations and lubricity factors

| | FFA (%) | Si (PPM) | Na (PPM) | K (PPM) | B (PPM) | P (PPM) | Zn (PPM) | Ca (PPM) | Mg (PPM) | Sterol (NMR) | wear scar ($\mu M^2$) | C of F* | LN |
|---|---|---|---|---|---|---|---|---|---|---|---|---|---|
| P**-0*** | 1.244 | 0 | 0 | 1 | 1 | 8 | 1 | 12 | 3 | 0.024 | 0.2634 | 0.1270 | 0.8193 |
| P-1 | 1.231 | 1 | 1 | 0 | 3 | 4 | 0 | 1 | 1 | 0.021 | 0.2732 | 0.1179 | 0.8507 |
| P-2 | 0.084 | 1 | 7 | 0 | 2 | 1 | 0 | 0 | 0 | 0.022 | 0.2830 | 0.1239 | 0.7800 |
| P-3 | 0.070 | 1 | 0 | 0 | 1 | 0 | 0 | 0 | 0 | 0.021 | 0.2689 | 0.1222 | 0.8359 |
| P-4 | 0.056 | 7 | 0 | 0 | 0 | 0 | 0 | 0 | 0 | 0.018 | 0.2754 | 0.1218 | 0.8167 |
| PS-0 | 1.866 | 2 | 1 | 32 | 1 | 168 | 1 | 70 | 33 | 0.240 | 0.2519 | 0.1143 | 0.9543 |
| PS-1 | 1.840 | 2 | 1 | 8 | 2 | 57 | 0 | 20 | 9 | 0.011 | 0.2944 | 0.1092 | 0.8527 |
| PS-2 | 0.141 | 1 | 2 | 0 | 1 | 5 | 0 | 4 | 0 | 0.027 | 0.2877 | 0.1233 | 0.7722 |
| PS-3 | 0.126 | 1 | 0 | 0 | 0 | 3 | 0 | 2 | 1 | 0.023 | 0.2716 | 0.1143 | 0.8844 |
| PS-4 | 0.084 | 3 | 0 | 0 | 0 | 2 | 0 | 2 | 2 | 0.007 | 0.2870 | 0.1171 | 0.8146 |
| S-0 | 4.573 | 10 | 8 | 209 | 1 | 1030 | 3 | 368 | 190 | 0.040 | 0.2365 | 0.1127 | 1.0318 |
| S-1 | 5.434 | 12 | 10 | 207 | 3 | 1040 | 3 | 378 | 190 | 0.042 | 0.2658 | 0.1143 | 0.9006 |
| S-2 | 0.310 | 10 | 45 | 4 | 1 | 207 | 0 | 273 | 74 | 0.034 | 0.2504 | 0.1228 | 0.8960 |
| S-3 | 0.364 | 10 | 42 | 3 | 1 | 199 | 0 | 255 | 71 | 0.035 | 0.2601 | 0.1082 | 0.9738 |
| S-4 | 0.364 | 10 | 41 | 3 | 0 | 197 | 0 | 255 | 69 | 0.033 | 0.2578 | 0.1241 | 0.8559 |

*Coefficient of friction

**P = pressed oil, PS = pressed and solvent extracted oil S = solvent extracted oil

***0 = unrefined, 1 = Degummed, 2 = Degummed and neutralized, 3 = Degummed, neutralized and bleached, 4 = Degummed, neutralized, bleached and deodorized.

Example 7

Influence of Canola Oil Additization on Wear and Fuel Economy

This example describes the canola lubricity field performance of a fully wear documented gasoline engine, a 3.0 L V6 Toyota Camry. Tests began with an additization rate of 250 ppm Canola Oil in unleaded commercial gasoline under summer driving conditions. To reference these tests a control summer test of 10,000 km was conducted without the canola oil present. The same motor oil Pennzoil SJ SAE 10W-30 was used throughout the reference and treatment test periods. Eight oil samples were taken. Data was analyzed in two parts, 0 to 5,800 km and 5,800 km to 10,510 km. The driving was 65% highway and 35% city. Starts totaled 458 Cold and 327 Hot. Ambient temperatures ranged from a mean minimum of 8.5.degree. C. to a maximum of 20.8° C.

Canola oil supplemented gasoline produced a significant ICP wear reduction compared with the control. The overall averaged wear rate with regular gasoline was 0.99 ppm Fe/1,000 km while the instantaneous method yielded a rate of 0.87 ppm Fe/1,000 km for the reference fuel. The reference results exceeded the 0.63-0.66 ppm Fe/1,000 km obtained with canola oil present and revealed that canola oil additized fuel had resulted in a 33% wear reduction overall and a 26% reduction instantaneously. The average mileage obtained with canola oil present was 28.1 MPG while reference gas mileage was 4% better at 29.3 MPG. In this test canola oil additization lowered fuel economy.

The ferrography for reference gasoline revealed a wear particle density of 15 with other contaminants counting 8. The canola oil additized fuel run analysis indicated 14 for wear particles and 8 for other debris, indicating no effect of the treated fuel on larger ferrographic particles.

The filter analysis with 250 ppm canola oil additized fuel reveals rust, dirt, and varnish particles. The largest translucent particles of varnish measure about 200 μm. The spectrographic analysis of the filter residues indicated silicon, iron, copper traces and sodium. The presence and level of the contaminants is normal.

Both neutralization numbers were not affected significantly by canola oil treatment. Motor oil taken from the vehicle after operation on 250 ppm canola oil additized fuel lowered the total base number to 6.06 while the total acid number remained at 3.66.

After summer operation on gasoline containing 250 ppm canola oil (6,261 km) viscosity was lowered to 57.6 cSt at 40° C. and 8.95 cSt at 100° C. This represented a 17% drop in viscosity at 40° C. and an 18% change at 100° C. Also the presence of 1% fuel dilution of the oil was indicated after driving 10,243 km, when the oil was changed.

Example 8

Influence of Canola Methyl Ester additization on Wear and Fuel Economy

This example describes the Canola lubricity field performance of a fully wear documented gasoline engine, a 3.0 L V6 Toyota Camry. Tests began with an additization rate of 125 ppm canola oil methyl ester (CME) in unleaded commercial gasoline under summer driving conditions. To reference these tests a control summer test of 10,000 km was conducted without the canola methyl ester present. The same motor oil Pennzoil SJ SAE 10W-30 was used through out the reference and treatment test periods. For canola methyl ester additization tests a distance of 10,017 km was covered with 74% highway driving. Cold starts added up to 278 while hot starts equaled 311. Temperature means ranged from 12.3° C. to 25.4° C.

The ICP iron wear rates were remarkably low with the 125 ppm CME treatment. The overall rate method yielded only 0.50 ppm Fe/1,000 km while the instant point-to-point mean was similar at 0.48 ppm Fe/1,000 km. This lower CME treatment resulted in 49% to 45% wear reduction compared to the unadditized reference. It is clearly illustrated that CME wear performance is superior to both the reference and the 250 ppm canola oil additized fuel performance. Both canola additives are considerably better than the reference regular gasoline. The calculated mean fuel economy with 125 ppm CME was some 5% better than for the reference gasoline, yielding 30.8 MPG compared to the former 29.3 miles per Imperial gallon on regular gasoline.

The consistency of the reference wear readings were established by comparing average ICP data wear rates for regular gasoline. These averages were 0.87, 0.85, 0.99 and 0.87 ppm Fe/1,000 km. On the basis of this long-term reference, the listed per-cent summer wear rate reductions were 33% and 28% for instantaneous and cumulative wear when operating on 125 ppm CME.

Ferrography analysis of motor oil obtained after operation on 125 ppm CME totaled 6 wear particles and 2 other particles. This represents a reduction of 60% and 87% reduction from reference analysis. Most of these wear metals were described in the ferrography reports as "low alloy steel showing rubbing/sliding wear" although it is difficult to distinguish between very small steel and cast-iron particles, originating from the cylinder block.

The last filter obtained after operation on 125 ppm CME had far less debris in it compared to the other two filters. The white filter paper support shows through the particles, which are at a much lower concentration. Dirt/dust, rust and varnish are the major contaminants. The presence of silicon, iron, and traces of lead, copper and tin appeared spectrographically.

Operation on the CME additized fuel lowered the TBN to 6.19 while the TAN climbed to 4.20. This revealed that both neutralization numbers were not affected significantly by the Canola methyl ester.

Viscosity of the motor oil was also determined after operation on 125 ppm CME. After the 10,016km ended, the oil tested 59.4 at 40° C., a 13% drop. For 100° C. the values 9.43 cSt were reported, with a 14% drop. Viscosity performance was within specifications With 125 ppm Canola Methyl Ester added to the gasoline engine wear rate was reduced by almost one-half, to only 0.5 ppm Fe/1,000 km, potentially doubling engine life. Field fuel economy rose by 5%. The engine oil remained within neutralization and viscosity specifications after some 10,000 km of field-testing. The ferrographic and oil filter debris levels were markedly reduced and appeared normal. Furthermore no driveability or other engine performance problems were detected as the result of the specific CME treatment rate used in unleaded regular gasoline.

Example 9

Winter Canola Oil Gasoline Field Testing, Wear and Fuel Economy

This example describes the Canola lubricity field performance of a fully wear documented gasoline engine, a 3.0 L V6 Toyota Camry. Tests began with an additization rate of 250 ppm canola oil in unleaded commercial gasoline under winter driving conditions. To reference these tests a series of winter reference runs were performed without the additive. The same motor oil Pennzoil SJ SAE 10W-30 was used through out the reference and treatment test periods.

The reference wear rate data was recorded reflecting the accumulation of iron (ppmFe/1,000 km value) averaged 2.24 (overall) and 1.91 (measuring point to point). Reference gasoline economy records averaged 24.5 MPG. The numbers of cold and hot starts during the winter reference period were recorded. Mean ambient winter temperatures were in the -15° C. to -7° C. range. The proportion of highway driving was calculated as 71% and 43% for the reference tests.

The canola oil additive was pre-mixed with 50% gasoline to facilitate tank blending upon cold refueling. The canola oil test data involved 224 cold and 101 hot starts with 72% highway driving. The fuel economy rose to 27.5 MPG, a 12% improvement in referenced shorter-term mileage. Regular gasoline and the 250 ppm canola oil additive were compared. Calculations indicated that wear rates decreased slightly with 250 ppm canola oil additized fuel, to 2.02 and 1.73 ppm Fe/1,000 km. These reductions in wear were 6% and 20% based on the long-term reference and 10% and 9% based on the shorter-term comparative regular gas references.

For the canola oil additized fuel treatment, the level of ferrographic wear particles reached "12" while contaminants remained at "7". This represented 11% lower wear particle count than previously referenced. The magnetic iron trend remained very low and unchanged at 0.2 μg/mL.

The oil filter taken after operation on 250 ppm canola oil additized fuel revealed contaminants as dirt, rust and varnish. The spectrographic analysis revealed iron, silicon, and traces of sodium, copper, and potassium in the filter debris. Filter analysis results were normal.

The winter 250 ppm canola oil fuel additive resulted in a 5.8 TBN and a 2.5 TAN indication. This 5.8 reading revealed a similar drop in reserve alkalinity for TBN, noting the 5.7 TBN for the reference fuel. The TAN of 2.5 for canola oil additized fuel treatment had not varied significantly from the 2.5 value for new oil or the 2.7 value for oil after operation on the reference fuel.

Motor oil obtained after operation on 250 ppm canola oil additized fuel under winter operation conditions had viscosity of 48.5 cSt at 40° C. and 8.73 cSt at 100° C. The viscosity had decreased 21% at 40° C. and 17% drop at 100° C. from new oil. Compared to regular fuel, the relative additional loss of viscosity was 5% at 40° C. and 4% at 100° C. for the canola oil additized gasoline.

Example 10

Winter Canola Methyl Ester Gasoline Field Testing, Wear and Fuel Economy

This example describes the Canola lubricity field performance of a fully wear documented gasoline engine, a 3.0 L V6 Toyota Camry. Tests began with an additization rate of 250 ppm canola methyl ester in unleaded commercial gasoline under winter driving conditions. To reference these tests a series of winter reference runs were performed without the additive. The same motor oil Pennzoil SJ SAE 10W-30 was used through out the reference and treatment test periods.

The reference wear rate data was recorded reflecting the accumulation of iron (ppmFe/1,000 km value) averaged 2.24 (overall) and 1.91 (measuring point to point). Reference gasoline economy records averaged 24.5 MPG. The numbers of cold and hot starts during the winter reference period were recorded. Mean ambient winter temperatures were -7.9° C. and -3.7° C. the daily averaged minimum and maximums. The proportion of highway driving was calculated as 71% and 43% for the reference tests.

The canola methyl ester tests spanned 4,202 km with 106 cold and 113 hot starts logged with 72% highway driving. The average fuel economy during this test was 27.0 MPG, some 10% better compared to the regular gas references. The net wear iron in the two winter test runs was compared. The gasoline alone graph climbs higher than with 250 ppm the canola methyl ester supplement. The engine-wear iron spectrometry calculations revealed rates of 1.55 and 1.27 ppm Fe/1,000 km with canola methyl ester. These were 28% and 41% lower than the long-term references and 31% and 41% below the shorter-term gasoline references. No driveability problems were experienced, with good power, starting, and stable idling rpm demonstrated while using 250 ppm canola methyl ester as a gasoline additive.

With the canola methyl ester additive, ferrography indicated wear particles were at the "13" level while a ranking of "8" appeared for contaminants. Most metal particles are low alloy steel showing rubbing/sliding. Traces of copper/copper alloy (up to 40 microns) present were comments; The magnetic iron trend stayed minimally the same at 0.2 μg/mL.

Analysis of the oil filter after operation on 250 ppm canola methyl ester in winter conditions indicated that contaminants were dirt, dust, rust and varnish. The debris texture looked fine with some metallic reflections. Spectrographic analysis revealed silicon, iron, and traces of sodium, potassium, copper and tin in the residue. These filter results were also judged normal.

Oil viscosity from oil taken after operation on canola methyl ester for 4,104 km was 51.9 cSt at 40° C. and 9.46 at 100° C. No fuel dilution of the motor oil was observed during the trial. These test values represented similar viscosity to that obtained after similar operation on reference gasoline. The 250 ppm canola methyl ester treatment under winter conditions appeared better in terms of viscosity dilution than the 250 ppm canola oil additive.

What is claimed is:

1. A process for enhancing the lubricity characteristics of a fuel, the process comprising:

(a) pressing a solid source plant or animal material containing oils, fats and greases to provide a first extract of oils, fats and greases having lower levels of lubricity enhancing compounds, and a pressed solid source material;

(b) extracting said pressed solid source material to provide a second extract of an oil, fat and grease concentrate comprising triacyl glycerol molecules;

(c) chemically modifying said triacyl glycerol molecules in the second extract of said oil, fat and grease so as to lower the average molecular weight thereof and produce modified triglyceride products;

(d) fractionating said modified triglyceride products into first and second fractions wherein constituents of the first fraction are higher in molecular weight than a molecular weight of constituents of the second fraction and wherein the first higher molecular weight fraction includes lubricity enhancing compounds comprising dolichol, polyprenols, squalene and tocopherols;

(e) collecting the first fraction of step (d) so as to provide a concentrate of said lubricity enhancing compounds; and (f) adding said concentrate to the fuel.

2. A process as claimed in claim 1, wherein:

(i) step (d) includes distilling said modified triglyceride products so as to produce the second fraction as a distillate and the first fraction as a concentrate residue; and (ii) step(e) includes collecting said concentrate residue of lubricity enhancing compounds.

3. A process as claimed in claim 1, wherein step (d) includes treating said modified triglyceride products by size exclusion chromatography so as to produce the second fraction and the first fraction.

4. A process as claimed in claim 1, wherein step (d) includes selectively crystallizing said modified triglyceride products so as to produce the second fraction and the first fraction.

5. A process as claimed in claim 1, wherein said chemical modifying step (c) comprises converting said triacyl glycerol molecules to at least one of alkyl esters, alcohols, amides, alkanes, aldehydes, fatty acids and amines so as to lower the average molecular weight for producing the second fraction.

6. The process according to claim 1, wherein the fats are from tall oil.

7. The process according to claim 1, wherein the plant source is soybean, canola, palm, sunflower, rapeseed, flaxseed, corn or coconut.

8. The process according to claim 1, wherein the animal source is swine, poultry or beef.

9. The process for enhancing the lubricity characteristics of a fuel as defined in claim 1, the fuel being at least one of kerosene, diesel fuel, jet fuel, gasoline fuel, or motor oil.

10. A lubricity enhancing fuel product produced according to the process as defined in claim 1, wherein the fuel is at least one selected from the group consisting of kerosene, diesel fuel, jet fuel, gasoline fuel, and motor oil; and having adding thereto said high molecular weight fractions comprising said lubricity enhancing compounds.

* * * * *